US006719643B1

(12) United States Patent
Helmstetter et al.

(10) Patent No.: US 6,719,643 B1
(45) Date of Patent: Apr. 13, 2004

(54) GOLF CLUB HEAD WITH A FACE INSERT

(75) Inventors: Richard C. Helmstetter, Rancho Santa Fe, CA (US); Alan Hocknell, Encinitas, CA (US); D. Clayton Evans, San Marcos, CA (US); Roger Cleveland, Los Angeles, CA (US); Matthew T. Cackett, San Diego, CA (US); Augustin W. Rollinson, Carlsbad, CA (US); Garth W. Smith, Oceanside, CA (US); Homer E. Aguinaldo, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 10/248,723

(22) Filed: Feb. 12, 2003

(51) Int. Cl.[7] ..... A63B 53/02

(52) U.S. Cl. ..... 473/305; 473/345; 473/349; 473/342

(58) Field of Search ..... 473/324, 305, 473/345, 346, 349, 329, 290, 291, 334, 335, 336, 337, 338, 339, 342, 350

(56) References Cited

U.S. PATENT DOCUMENTS

| | | | |
|---|---|---|---|
| 1,167,387 | A | 1/1916 | Daniel |
| 1,638,916 | A | 8/1927 | Butchart |
| 1,780,625 | A | 11/1930 | Mattern |
| 2,750,194 | A | 6/1956 | Clark |
| 3,692,306 | A | 9/1972 | Glover |
| 3,897,066 | A | 7/1975 | Belmont |
| 3,937,474 | A | 2/1976 | Jepson et al. |
| 3,970,236 | A | 7/1976 | Rogers |
| 3,975,023 | A | 8/1976 | Inamori |
| 3,989,248 | A | 11/1976 | Campau |
| 4,021,047 | A | 5/1977 | Mader |
| 4,398,965 | A | 8/1983 | Campau |
| 4,568,088 | A | 2/1986 | Kurahashi |
| 4,872,685 | A | 10/1989 | Sun |
| 4,877,249 | A | 10/1989 | Thompson |
| 5,024,437 | A | 6/1991 | Anderson |
| 5,094,383 | A | 3/1992 | Anderson |
| 5,106,094 | A | 4/1992 | Desbiolles et al. |
| 5,163,682 | A | 11/1992 | Schmidt et al. |
| 5,193,811 | A | 3/1993 | Okumoto et al. |
| 5,255,918 | A | 10/1993 | Anderson |
| 5,261,663 | A | 11/1993 | Anderson |
| 5,261,664 | A | 11/1993 | Anderson |
| 5,282,624 | A | 2/1994 | Viste |
| 5,310,185 | A | 5/1994 | Viollez et al. |
| 5,318,300 | A | 6/1994 | Schmidt et al. |
| 5,344,140 | A | 9/1994 | Anderson et al. |
| 5,346,216 | A | 9/1994 | Aizawa |
| 5,377,986 | A | 1/1995 | Viollaz et al. |
| 5,398,935 | A | 3/1995 | Katayama |
| 5,410,798 | A | 5/1995 | Lo |
| 5,425,538 | A | 6/1995 | Vincent et al. |
| 5,464,210 | A | 11/1995 | Davis et al. |
| 5,474,296 | A | 12/1995 | Schmidt et al. |
| 5,499,814 | A | 3/1996 | Lu |
| 5,516,107 | A | 5/1996 | Okumoto et al. |
| 5,547,427 | A | 8/1996 | Rigal et al. |
| 5,570,886 | A | 11/1996 | Rigal et al. |
| 5,624,331 | A | 4/1997 | Lo et al. |

(List continued on next page.)

*Primary Examiner*—Sebastiano Passaniti
(74) *Attorney, Agent, or Firm*—Michael A. Catania; Elaine H. Lo

(57) ABSTRACT

A golf club head (20) having a body (22) with a front wall (30) with an opening (32) and a striking plate insert (40) is disclosed herein. The golf club head (20) has a volume between 370 cubic centimeters and 425 cubic centimeters. The golf club head (20) has a mass between 140 grams and 215 grams. The golf club head (20) has a moment of inertia, Izz, about the Z axis through the center of gravity of the golf club head ranging from 3200 g-cm$^2$ to 3900 g-cm$^2$.

6 Claims, 5 Drawing Sheets

U.S. PATENT DOCUMENTS

| | | | | |
|---|---|---|---|---|
| 5,743,813 | A | | 4/1998 | Chen et al. |
| 5,776,011 | A | | 7/1998 | Su et al. |
| 5,830,084 | A | | 11/1998 | Kosmatka |
| 5,863,261 | A | | 1/1999 | Eggiman |
| 5,888,148 | A | | 3/1999 | Allen |
| 6,010,411 | A | | 1/2000 | Reyes |
| 6,048,278 | A | | 4/2000 | Meyer et al. |
| 6,146,571 | A | | 11/2000 | Vincent et al. |
| 6,149,534 | A | | 11/2000 | Peters et al. |
| 6,152,833 | A | | 11/2000 | Werner et al. |
| 6,165,081 | A | | 12/2000 | Chou |
| 6,354,962 | B1 | | 3/2002 | Galloway et al. |
| 6,368,234 | B1 | | 4/2002 | Galloway |
| 6,386,990 | B1 | | 5/2002 | Reyes et al. |
| 6,398,666 | B1 | | 6/2002 | Evans et al. |
| 6,425,832 | B2 | * | 7/2002 | Cackett et al. ..... 473/345 |
| 6,440,011 | B1 | | 8/2002 | Hocknell et al. |
| 6,471,604 | B2 | | 10/2002 | Hocknell et al. |
| 6,491,592 | B2 | | 12/2002 | Cackett et al. |
| 6,527,650 | B2 | * | 3/2003 | Reyes et al. ..... 473/345 |
| 6,547,676 | B2 | * | 4/2003 | Cackett et al. ..... 473/345 |
| 6,565,452 | B2 | * | 5/2003 | Helmstetter et al. ..... 473/342 |
| 6,582,323 | B2 | * | 6/2003 | Soracco et al. ..... 473/342 |
| 6,607,452 | B2 | * | 8/2003 | Helmstetter et al. ..... 473/345 |
| 6,648,773 | B1 | * | 11/2003 | Evans ..... 473/342 |
| 6,669,578 | B1 | * | 12/2003 | Evans ..... 473/342 |
| 6,669,580 | B1 | * | 12/2003 | Cackett et al. ..... 473/345 |
| 6,672,975 | B1 | * | 1/2004 | Galloway ..... 473/342 |

* cited by examiner

GOLF CLUB HEAD WITH A FACE INSERT

CROSS REFERENCE TO RELATED APPLICATIONS

Not Applicable

FEDERAL RESEARCH STATEMENT

[Not Applicable]

BACKGROUND OF INVENTION

1. Field of the Invention

The present invention relates to a golf club head. More specifically, the present invention relates to a golf club head with a face insert.

2. Description of the Related Art

High performance drivers employ relatively thin, high strength face materials.

These faces are either formed into the curved face shape then welded into a driver body component around the face perimeter, or forged into a cup shape and connected to a body by either welding or adhesive bonding at a distance offset from the face of up to 0.75 inch. In a popular embodiment of the sheet-formed face insert driver, the weld between the formed face insert and the investment cast driver body is located on the striking face, a small distance from the face perimeter. It is common practice for the face insert to be of uniform thickness and to design the surrounding driver body component to be of equal thickness. In this way there is continuity of face thickness across the weld.

Most face inserts are composed of a titanium alloy material. Titanium alloys are generally classified into three types depending on the microstructure of the material developed after processing of the material. The three types are alpha alloys, alpha-beta alloys and metastable alloys, and these represent the phases present in the alloy at ambient temperatures. At ambient temperatures, the thermodynamic properties of titanium favors the alpha phase. However, alloying titanium with other elements allows for the high temperature beta phase to be present at ambient temperatures, which creates the alpha-beta and metastable beta microstructures. The metastable phase may be transformed into the alpha phase by heating the alloy to an intermediate elevated temperature, which results in a metastable titanium alloy with increased static strength.

Such high strength metastable titanium alloys have been used as face inserts for drivers with a high coefficient of restitution. However, the heat treatment process compromises the toughness of the material, where toughness is defined as the resistance of the material to fracture under loading. Thus, even heat treated, high strength, metastable titanium alloys have limited application as face inserts due to inferior fracture properties. Thus, there is a need for face inserts composed of titanium alloys with an appropriate microstructure for better fracture properties. This requires a proper balance between strength and toughness (resistance to fracture), without a substantial increase in the costs associated with manufacturing the face insert.

Several patents discloses face inserts. Anderson, U.S. Pat. Nos. 5,024,437, 5,094,383, 5,255,918, 5,261,663 and 5,261664 disclose a golf club head having a full body composed of a cast metal material and a face insert composed of a hot forged metal material.

Viste, U.S. Pat. No. 5,282,624 discloses a golf club head with a cast metal body and a forged steel face insert with grooves on the exterior surface and the interior surface of the face insert and having a thickness of 3 mm.

Rogers, U.S. Pat. No. 3,970,236, discloses an iron club head with a formed metal face plate insert fusion bonded to a cast iron body.

Galloway, et alii, U.S. Pat. No. 6,354,962 discloses a golf club head of a face cup design.

However, there is a need for a golf club head with a face insert that is better performing than conventional face insert club heads and provides cost savings.

SUMMARY OF INVENTION

The present invention overcomes the problems of the prior art by providing a golf club head that has a body with a striking plate insert composed of a titanium alloy material. The golf club head has a large volume, a large moment of inertia about the center of gravity, a high COR, and a deep face. This allows the golf club head of the present invention to have better performance than a conventional face insert golf club head.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
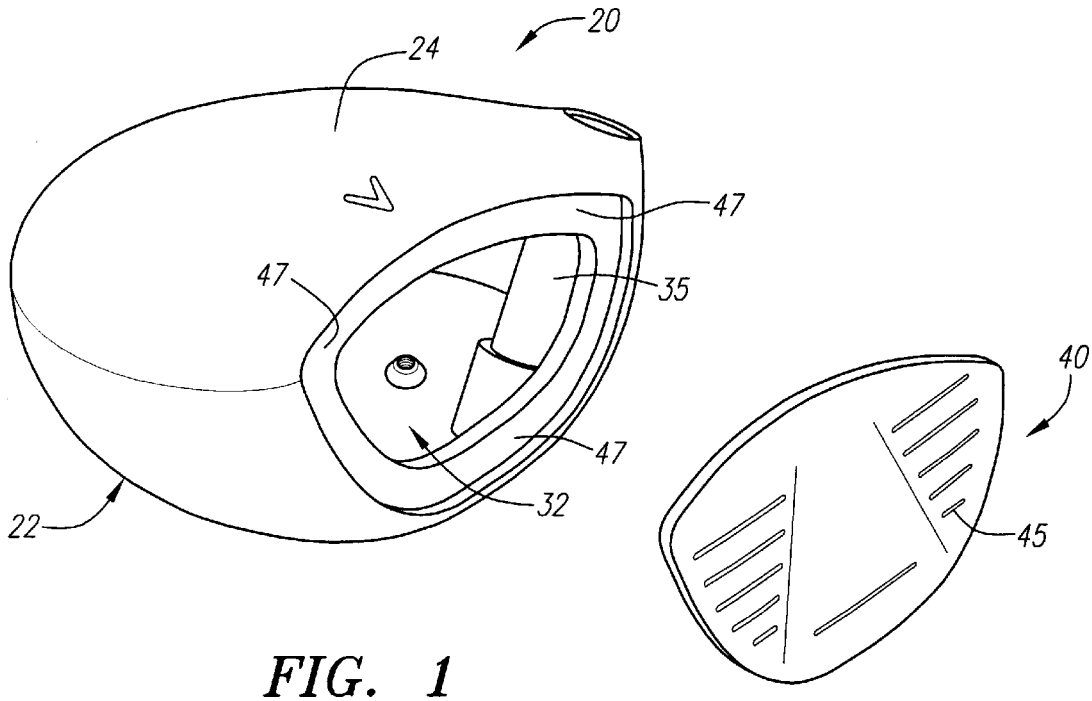
FIG. 1 is an exploded view of the components of a preferred embodiment of the golf club head of the present invention.
Figure 2:
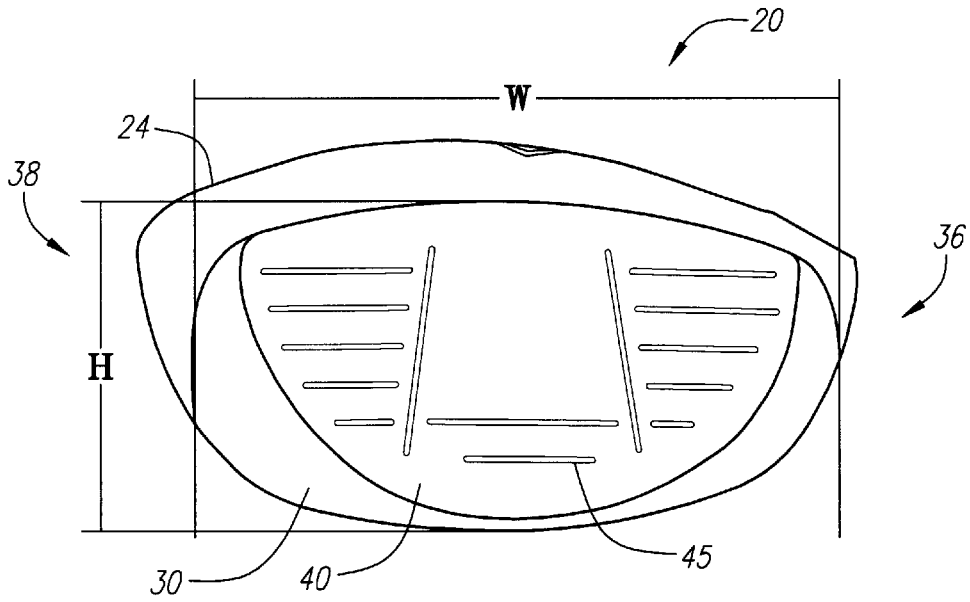
FIG. 2 is a front view of a golf club head of the present invention.
Figure 3:
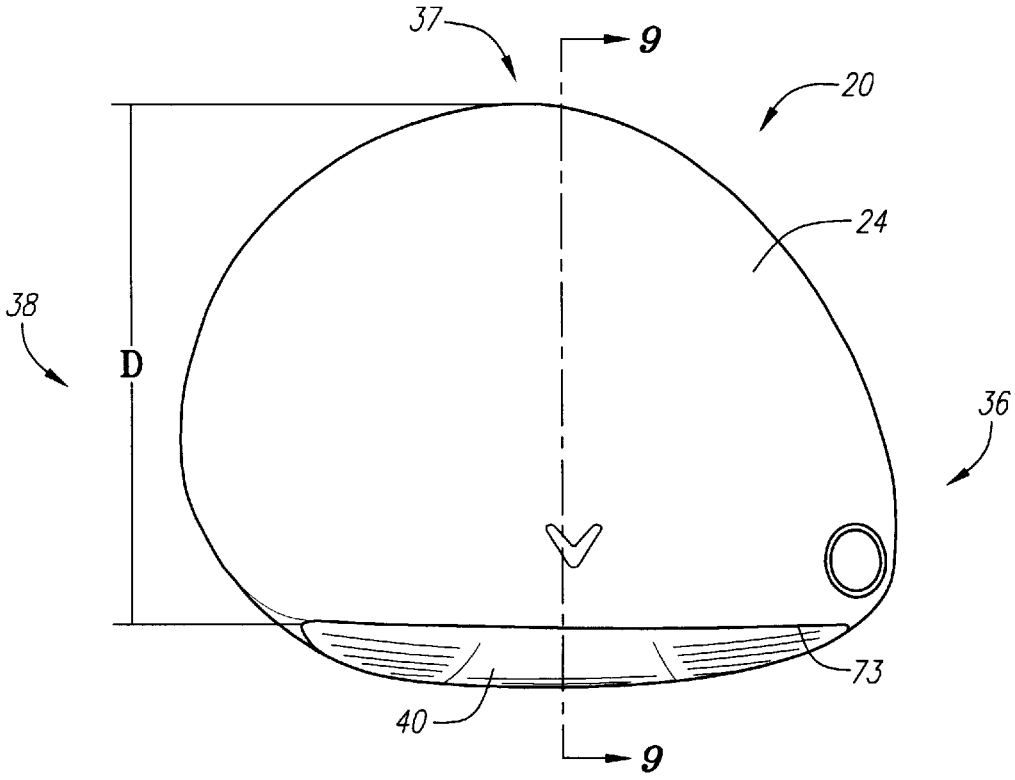
FIG. 3 is a top plan view of a golf club head of the present invention.
Figure 4:
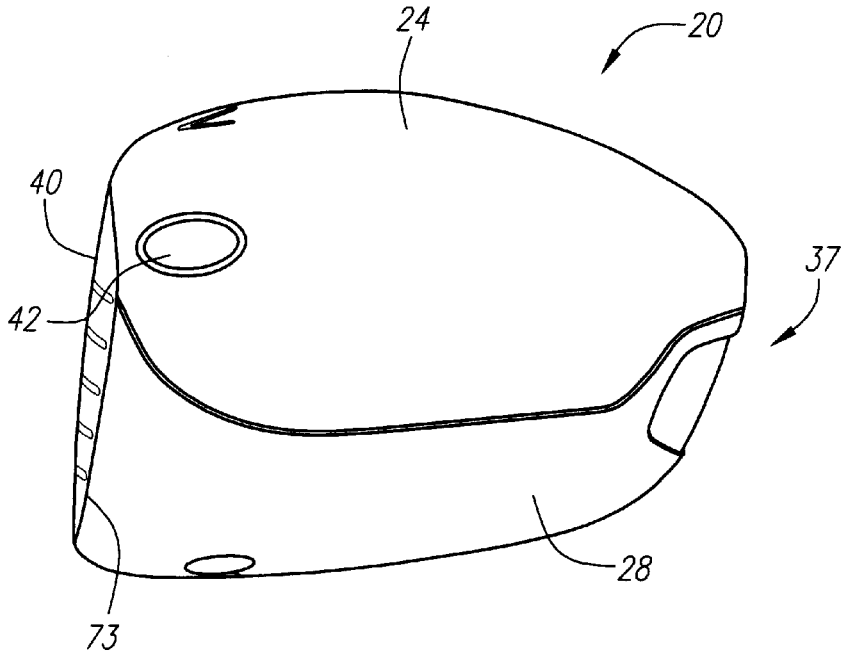
FIG. 4 is a side view of the heel end of a golf club head of the present invention.
Figure 5:
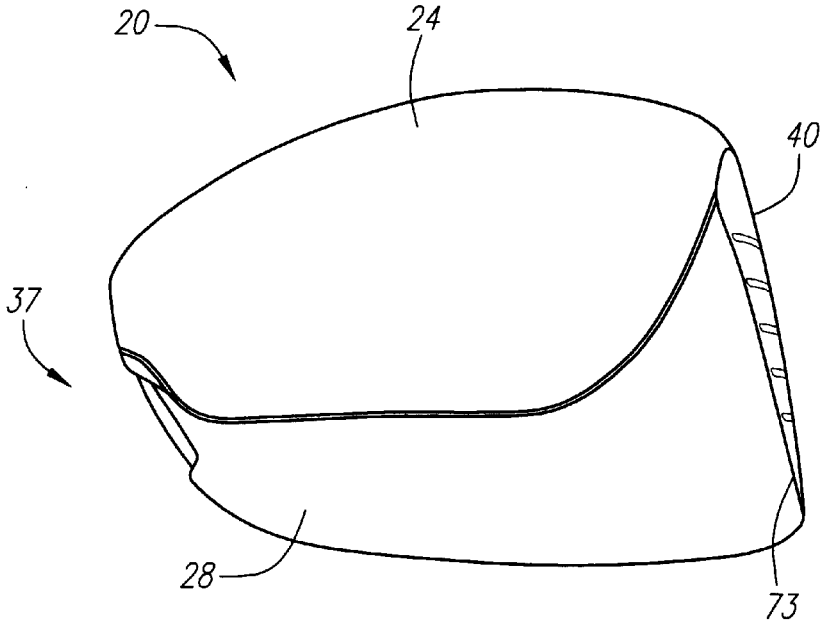
FIG. 5 is side view of the toe end of a golf club head of the present invention.
Figure 6:
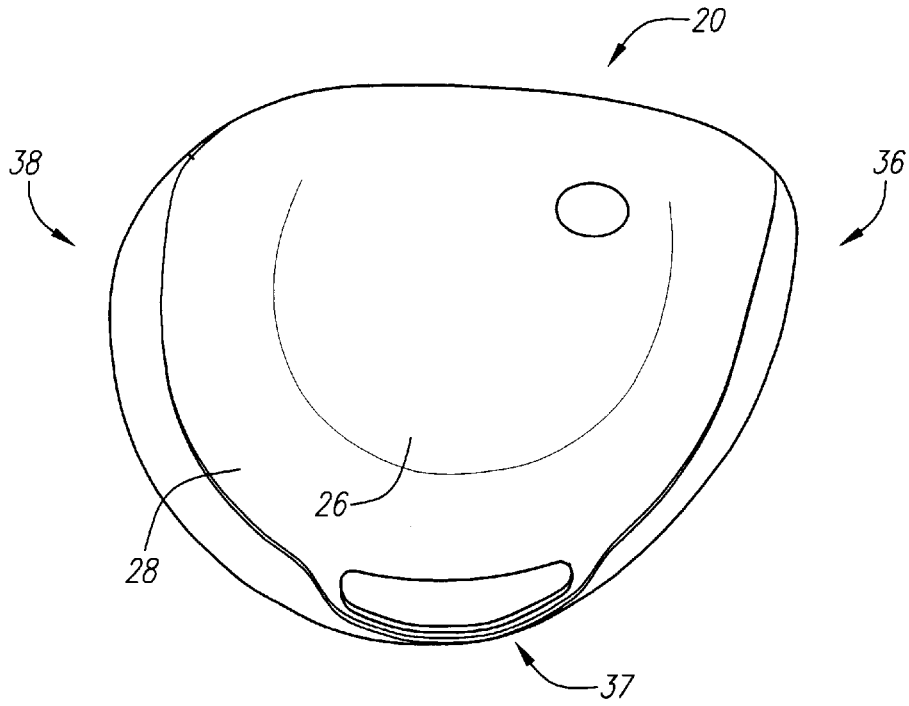
FIG. 6 is a bottom plan view of a golf club head of the present invention.
Figure 7:
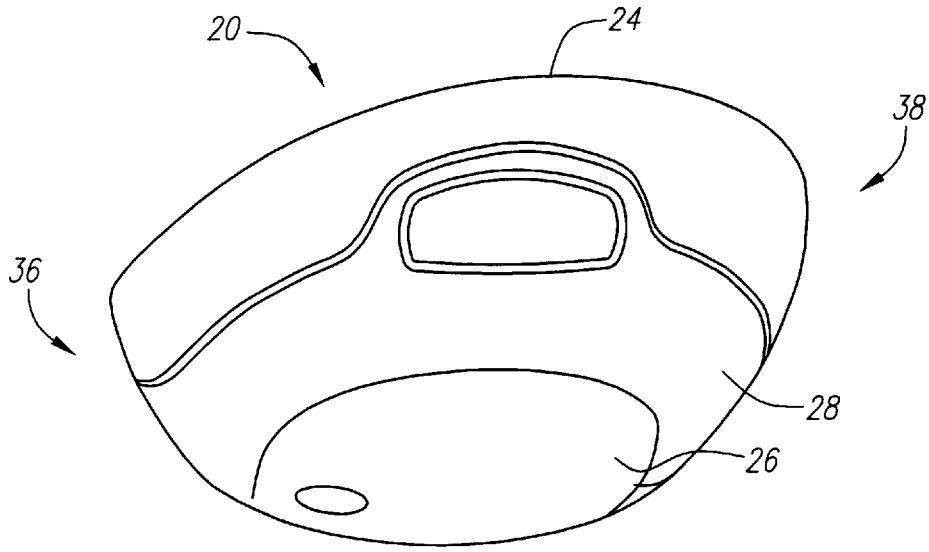
FIG. 7 is a rear view of a golf club head of the present invention.
Figure 8:
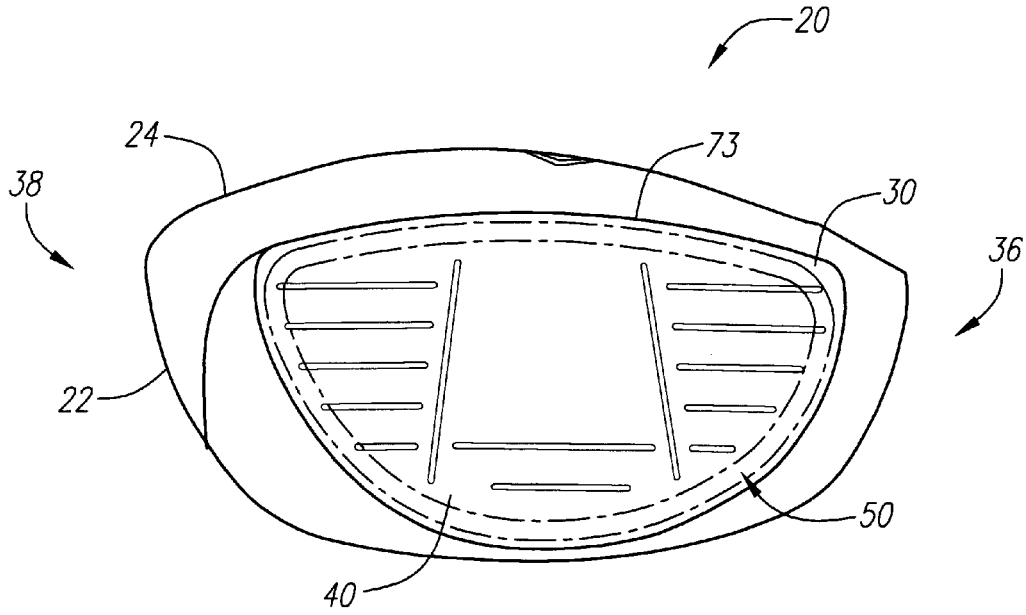
FIG. 8 a front view of a golf club head of the present invention showing the perimeter region in dashed lines.

As shown in FIGS. 1–9, the golf club head of the present invention is generally designated 20. The golf club head 20 of FIGS. 1–9 is a driver, however, the golf club head of the present invention may alternatively be a fairway wood. The golf club head 20 has a body 22 that is preferably composed of a metal material such as titanium, titanium alloy, or the like, and is most preferably composed of a cast titanium alloy material. The body 22 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 22 is composed of 17-4 steel alloy. Additional methods for manufacturing the body 22 include forming the body 22 from a flat sheet of metal, super-plastic forming the body 22 from a flat sheet of metal, machining the body 22 from a solid block of metal, electrochemical milling the body from a forged pre-form, casting the body using centrifugal casting, casting the body using levitation casting, and like manufacturing methods.

The golf club head 20, when designed as a driver, preferably has a volume from 200 cubic centimeters to 600 cubic centimeters, more preferably from 300 cubic centimeters to 450 cubic centimeters, and most preferably from 360 cubic centimeters to 425 cubic centimeters. A golf club head 20 for a driver with a body 22 composed of a cast titanium alloy most preferably has a volume of 380 cubic centimeters. The volume of the golf club head 20 will also vary between fairway woods (preferably ranging from 3-woods to eleven woods) with smaller volumes than drivers.

The golf club head 20, when designed as a driver, preferably has a mass no more than 215 grams, and most preferably a mass of 180 to 215 grams. When the golf club head 20 is designed as a fairway wood, the golf club head preferably has a mass of 135 grams to 180 grams, and preferably from 140 grams to 165 grams.

The body 22 has a crown 24, a sole 26, a ribbon 28, and a front wall 30 with an opening 32. The body 22 preferably has a hollow interior 34. The golf club head 20 has a heel end 36, a toe end 38 and an aft end 37. A shaft, not shown, is placed within an interior hosel 35 at the heel end 36. The interior hosel 35 is within the hollow interior 34 of the body 22, and the interior hosel 35 extends from the crown 24 to the sole 26. The interior hosel 35 is preferably cast with the entirety of the body 22. However, the interior hosel 35 may be a separate component that is attached through welding or other means to the body 22.

The golf club head 20 has striking plate insert 40 that is attached to the body 22 over the opening 32 of the front wall 30. The striking plate insert 40 preferably is composed of a formed titanium alloy material. Such titanium materials include titanium alloys such as 6-22-22 titanium alloy and Ti 10-2-3 alloy, Beta-C titanium alloy, all available from RTI International Metals of Ohio, SP-700 titanium alloy (available from Nippon Steel of Tokyo, Japan), DAT 55G titanium alloy available from Diado Steel of Tokyo, Japan, and like materials. The preferred material for the striking plate insert 40 is a heat treated 6-22-22 titanium alloy which is a titanium alloy composed by weight of titanium, 6% aluminum, 2% tin, 2% chromium, 2% molybdenum, 2% zirconium and 0.23% silicon. The titanium alloy will have an alpha phase in excess of 40% of the overall microstructure. As shown in FIG. 1, the striking plate insert 40 typically has a plurality of scorelines 45 thereon.

As shown in FIG. 1, the striking plate insert 40 is preferably welded to the front wall 30 of the body 22, thereby covering the opening 32. A plurality of tabs 47, preferably three, align the striking plate insert 40 for the welding process.

Alternatively, the striking plate insert 40 is press-fitted into the opening 32.

In a preferred embodiment, the striking plate insert 40 has uniform thickness that ranges from 0.040 inch to 0.250 inch, more preferably a thickness of 0.080 inch to 0.120 inch, and is most preferably 0.108 inch for a titanium alloy striking plate insert 40.

In a preferred embodiment, the striking plate insert 40 has a mass ranging from 26 grams to 32 grams, and most preferably 28 grams. In a preferred embodiment, the body 22 has a mass ranging from 150 grams to 165 grams, and most preferably 159 grams. In a preferred embodiment, a weld between the striking plate insert 40 and the body 22 has a mass of 6 grams. In a preferred embodiment, the striking plate insert 40 is less than 20% of the mass of the body 22 and preferably ranges from 15% to 20% of the mass of the body 22. Further, in a preferred embodiment, the striking plate insert 40 is preferably less than 15% of the mass of the golf club head 20 and more preferably ranges from 10% to 15% of the mass of the golf club head 20.

The present invention is directed at a golf club head that has a high coefficient of restitution thereby enabling for greater distance of a golf ball hit with the golf club head of the present invention. The coefficient of restitution (also referred to herein as COR) is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head 20 preferably having a coefficient of restitution preferably ranging from 0.80 to 0.87, and more preferably from 0.82 to 0.86, as measured under standard USGA test conditions.

The depth of the club head 20 from the striking plate insert 40 to the aft-end 37 preferably ranges from 3.0 inches to 4.5 inches, and is most preferably 3.75 inches. The height, H, of the club head 20, as measured while in address position, preferably ranges from 2.0 inches to 3.5 inches, and is most preferably 2.50 inches or 2.9 inches. The width, W, of the club head 20 from the toe end 38 to the heel end 36 preferably ranges from 4.0 inches to 5.0 inches, and more preferably 4.7 inches.

Figure 9:
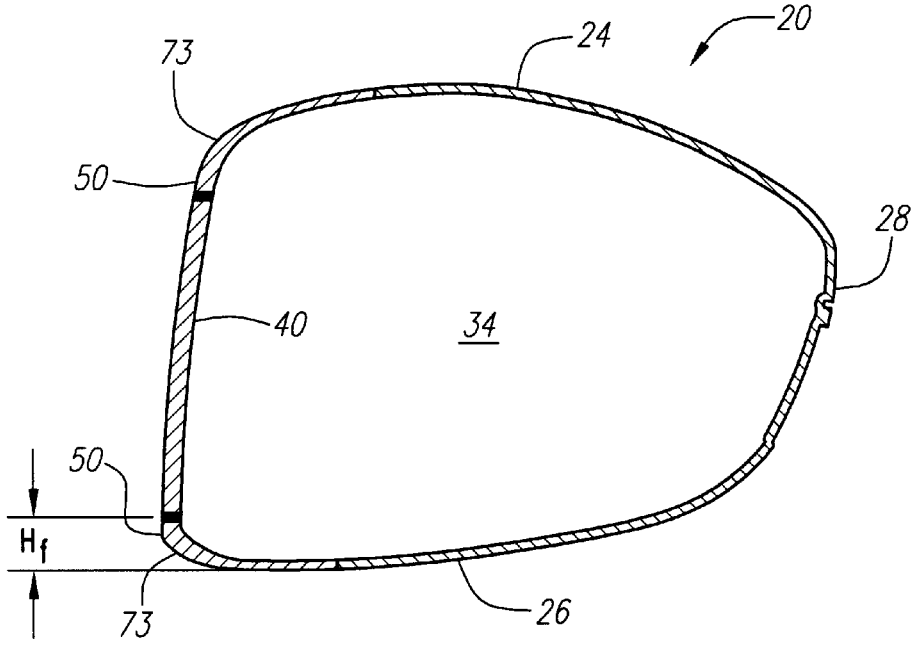
FIG. 9 is a cross-sectional view along line 9—9 of FIG. 3.

As shown in FIG. 9, the distance Hf between the lowest point of the sole 26 when the golf club head 20 is in the address position and the lowest point of the striking plate insert 40 is preferably approximately 0.5 inch. Further, the weld between the striking plate insert 40 and the body 22 is preferably approximately 0.03 inch, which provides for a more compliant face resulting in a higher COR.

The center of gravity and the moments of inertia of the golf club head 20 may be calculated as disclosed in co-pending U.S. patent application Ser. No. 09/796,951, filed on Feb. 27, 2001, entitled High Moment Of Inertia Composite Golf Club, and hereby incorporated by reference in its entirety. In general, the moment of inertia, Izz, about the Z axis of the center of gravity for the golf club head 20 will preferably range from 2700 g-cm$^2$ to 4000 g-cm$^2$, more preferably from 3400 g-cm$^2$ to 3900 g-cm$^2$. The large Izz value improves shot straightness and distance for heel-toe hits. The moment of inertia, Iyy, about the Y axis for the center of gravity of the golf club head 20 will preferably range from 2000 g-cm$^2$ to 3000 g-cm$^2$. The large Iyy value improves the backspin robustness and distance for both high and low hits on the face.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a body having a crown, a sole, a ribbon, and a front wall with an opening, the crown having a thickness of 0.035 inch to 0.045 inch, the sole having a thickness of 0.035 inch to 0.045 inch, the body composed of a cast titanium alloy material, the crown, the sole, the ribbon and the front wall defining a hollow interior; and a striking plate insert positioned within the opening and welded to the body, the striking plate insert having a uniform thickness in the range of 0.080 inch to 0.120 inch, the striking plate insert composed of a formed titanium alloy material;

an internal hosel positioned within the hollow interior of the body, the interior hosel extending from the crown to the sole;

wherein the golf club head has a volume ranging from 360 cubic centimeters to 425 cubic centimeters;

wherein the golf club head has a mass ranging from 185 grams to 215 grams;

wherein the golf club head has a height ranging from 2.0 inches to 3.5 inches and a width ranging from 4.0 inches to 5.0 inches;

wherein the golf club head has a coefficient of restitution ranging from 0.82 to 0.87; and wherein the golf club head has a moment of inertia, Izz, about the Z axis through the center of gravity of the golf club head ranging from 3400 g-cm$^2$ to 3900 g-cm$^2$.

2. A golf club head comprising:

a body having a crown, a sole, a ribbon, and a front wall with an opening, the crown having a thickness of 0.035 inch to 0.045 inch, the sole having a thickness of 0.035 inch to 0.045 inch, the front wall having a perimeter region encompassing the opening, the perimeter region having a thickness of 0.070 inch to 0.0110 inch, the body composed of a cast titanium alloy material, the crown; the sole, the ribbon and the front wall defining a hollow interior; and a striking plate insert positioned within the opening and welded to the body, the striking plate insert having a uniform thickness in the range of 0.080 inch to 0.120 inch, the striking plate insert composed of a formed titanium alloy material;

an internal hosel positioned within the hollow interior of the body, the interior hosel extending from the crown to the sole;

wherein the golf club head has a volume ranging from 360 cubic centimeters to 425 cubic centimeters;

wherein the golf club head has a mass ranging from 185 grams to 215 grams;

wherein the golf club head has a height ranging from 2.0 inches to 3.5 inches, a width ranging from 4.0 inches to 5.0 inches, a depth ranging from 3.0 inches to 4.5 inches;

wherein the golf club head has a coefficient of restitution ranging from 0.82 to 0.87; and wherein the golf club head has a moment of inertia, Izz, about the Z axis through the center of gravity of the golf club head ranging from 3400 g-cm$^2$ to 3900 g-cm$^2$.

3. A golf club head comprising:

a body having a crown, a sole, a ribbon, and a front wall with an opening, the crown having a thickness of 0.035 inch to 0.045 inch, the sole having a thickness of 0.035 inch to 0.045 inch, the front wall having a perimeter region encompassing the opening, the perimeter region having a thickness of 0.070 inch to 0.0110 inch, the body composed of a cast titanium alloy material, the crown, the sole, the ribbon and the front wall defining a hollow interior; and a striking plate insert positioned within the opening and welded to the body, the striking plate insert having a uniform thickness in the range of 0.080 inch to 0.120 inch, the striking plate insert composed of a formed titanium alloy material;

an internal hosel positioned within the hollow interior of the body, the interior hosel extending from the crown to the sole;

wherein the golf club head has a volume ranging from 360 cubic centimeters to 425 cubic centimeters;

wherein the golf club head has a mass ranging from 185 grams to 215 grams;

wherein the golf club head has a height ranging from 2.0 inches to 3.5 inches and a width ranging from 4.0 inches to 5.0 inches;

wherein the golf club head has a coefficient of restitution ranging from 0.82 to 0.87; and wherein the golf club head has a moment of inertia, Izz, about the Z axis through the center of gravity of the golf club head ranging from 3400 g-cm$^2$ to 3900 g-cm$^2$.

4. The golf club head according to claim 3 wherein a mass of the striking plate insert is less than 20% of a mass of the body.

5. The golf club head according to claim 3 wherein a mass of the striking plate insert is less than 15% of a mass of the golf club head.

6. The golf club head according to claim 3 wherein the golf club head has a moment of inertia, Iyy, about the Y axis through the center of gravity of the golf club head ranging from 2000 g-cm$^2$ to 3000 g-cm$^2$.

* * * * *